US005344336A

United States Patent [19]

Sampson

[11] Patent Number: 5,344,336

[45] Date of Patent: Sep. 6, 1994

[54] INSULATION DISPLACEMENT ELECTRICAL TERMINAL

[75] Inventor: Stephen A. Sampson, Downers Grove, Ill.

[73] Assignee: Molex Incorporated, Lisle, Ill.

[21] Appl. No.: 71,551

[22] Filed: Jun. 4, 1993

[51] Int. Cl.[5] ..... H01R 4/24

[52] U.S. Cl. ..... 439/397; 439/399

[58] Field of Search ..... 439/395–407

[56] References Cited

U.S. PATENT DOCUMENTS

| | | | |
|---|---|---|---|
| 3,910,671 | 10/1975 | Townsend | 439/397 |
| 3,964,816 | 6/1976 | Narozny | 339/99 R |
| 4,035,049 | 7/1977 | McKee | 439/407 |
| 4,125,311 | 11/1978 | Hoppe et al. | 439/406 |
| 4,373,769 | 2/1983 | Mathe et al. | 439/406 |
| 4,538,872 | 9/1985 | Brubaker et al. | 339/97 P |
| 4,793,822 | 12/1988 | Cozzens et al. | 439/397 |
| 4,940,425 | 7/1990 | Hass et al. | 439/397 |
| 5,021,012 | 6/1991 | Shibano | 439/397 |

*Primary Examiner*—David L. Pirlot
*Attorney, Agent, or Firm*—A. A. Tirva

[57] ABSTRACT

An insulation displacement terminal is provided for terminating a conductor of an insulated electrical wire. The terminal has a channel-shaped terminating section of a generally U-shaped cross-section provided by a pair of side walls joined by a base wall. A U-shaped distal end of the terminating section includes a conductor-receiving insulation displacing slot extending into each side wall generally parallel to the base wall. Reinforcing flanges extend along free edges of the side walls of the terminating section to prevent collapsing thereof when the conductor is forced into the slots.

3 Claims, 4 Drawing Sheets

INSULATION DISPLACEMENT ELECTRICAL TERMINAL

FIELD OF THE INVENTION

This invention generally relates to the art of electrical connectors and, particularly, to an insulation displacement terminal for an insulated electrical wire.

BACKGROUND OF THE INVENTION

A wide variety of methods and devices are available for terminating the conductor of an insulated electrical wire such that the conductor may provide a reliable electrical connection between circuitry apparatus of diverse type. Because of its inherent economies, a preferred method involves terminating a conductor to a terminal or contact member without previously stripping or removing the insulative cladding covering the conductor. Such a method is particularly well suited for use in the telecommunications or data processing industries, wherein electronic equipment often is field-installed or serviced. By eliminating the step of stripping the insulation from the conductor, significant economics are possible in the wiring of electronic or electrical apparatus.

In a common method which has become widely accepted, the insulative cladding of the conductor is severed by the edges of a slot formed in a terminal or contact member, permitting the insulative cladding to be displaced in the region of the connection. Such terminals most often are fabricated as stamped and formed sheet metal components. The insulation displacement slots most often are formed in generally planar walls of the sheet metal.

One form of insulation displacement terminal is elongated and includes a mating end, a terminating end and an intermediate section therebetween. The intermediate section mounts the terminal in a connector housing. The mating end is interengageable with a complementary terminal of a mating connector. The terminating end or section is channel-shaped of a generally U-shaped cross-section provided by a pair of side walls joined by a base wall. A U-shaped distal end of the terminating section includes a conductor-receiving insulation-displacing slot extending into each side wall of the section generally parallel to the base wall thereof. This structure leaves free arm portions of the side walls on the sides of the slots opposite the base wall. Problems have been encountered with such structures because the free arm portions of the side walls have a tendency to bend or collapse during termination of a conductor, i.e. during forcing of the conductor into the slots in the side walls of the terminating sections. This invention is directed to solving this problem by providing reinforcing means along the free edges of the side walls to prevent collapsing thereof.

SUMMARY OF THE INVENTION

An object, therefore, of the invention is to provide a new and improved insulation displacement terminal of the character described, for terminating a conductor of an insulated electrical wire.

As stated above, the terminal includes a channel-shaped terminating section of a generally U-shaped cross-section. This configuration defines a pair of side walls joined by a base wall. In turn, the side and base walls define a U-shaped distal end of the terminating section whereat a conductor-receiving insulation-displacing slot is provided in each side wall generally parallel to the base wall. Generally, the invention contemplates the provision of reinforcing means along free edges of the side walls of the terminating section of the terminal to prevent collapsing of the free arm portions of the side walls outside the slots therein.

More particularly, the reinforcing means extend generally parallel to the slots and are provided by elongated flanges projecting from the side walls generally parallel to the base walls. The flanges project inwardly toward each other to sort of partially close the channel configuration of the terminating section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
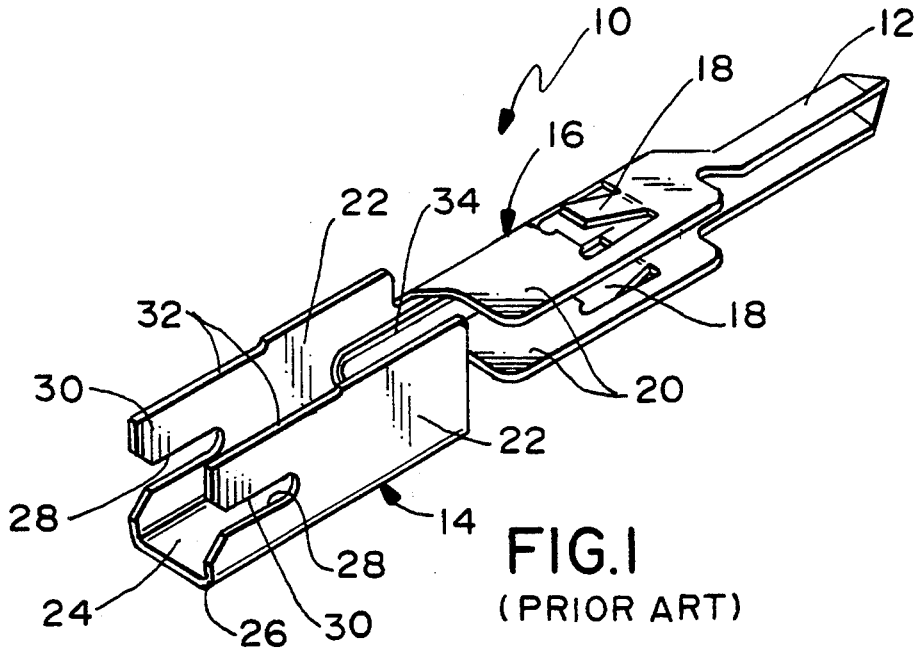
FIG.1 (PRIOR ART)
FIG. 1 is a perspective view of an insulation displacement terminal according to the prior art.

Referring to the drawings in greater detail, and first to FIG. 1, an insulation displacement terminal, generally designated 10, is illustrated according to the prior art, for terminating a conductor of an insulated electrical wire. Prior art terminal 10 is elongated and includes a mating end or section 12, a conductor terminating end or section, generally designated 14, and an intermediate mounting section, generally designated 16.

Mating end 12 is generally channel-shaped and defines a terminal or contact pin. The pin is interengageable in a socket or receptacle contact or terminal of a complementary connector (not shown).

Intermediate section 16 also is generally channel-shaped and is provided for mounting the terminal in an appropriate connector housing (not shown), such as inserting the terminal in a passage of the housing. Terminal 10 is stamped and formed from sheet metal material, and latch arms 18 are stamped out of a pair of side walls 20 of intermediate section 16. The latch arms are formed outwardly for snappingly engaging behind appropriate mounting shoulders within the connector housing.

Terminating section 14 of prior art terminal 10 is channel-shaped to define a generally U-shaped cross-section provided by a pair of side walls 22 joined by a base wall 24. A U-shaped distal end 26 of terminating section 14 includes a conductor-receiving, insulation-displacing slot 28 in each side wall 22 and extending generally parallel to base wall 24. It can be seen that slots 28 form free arm portions 30 outside the slots. The free arm portions, in turn, define free edges 32 of side walls 22. A strengthening rib or gusset 34 spans the base of intermediate section 16 and one of the side walls 22 of terminating section 14.

As stated in the "Background", above, a problem with prior art terminals as shown in FIG. 1 and described above, centers around the collapsing of the side walls of terminating section 14, particularly the free arm portions 30 of the side walls. In other words, when the conductor of an insulated electrical wire is inserted into slots 28, free arm portions 30 have a tendency to buckle or collapse under the insertion forces of the conductor. With slotted insulation displacement terminals, such as terminal 10, slots 28 must be slightly narrower than the conductor itself in order to have sufficient normal contacting forces between the conductor and the edges of the slots. This creates lateral spreading forces on the sheet metal side walls bounding the slot. While base wall 24 may provide support for the side walls 22 between slots 28 and the base wall, free arm portions 30 of the side walls remain unsupported and are prone to buckling or collapsing.

Figure 2:
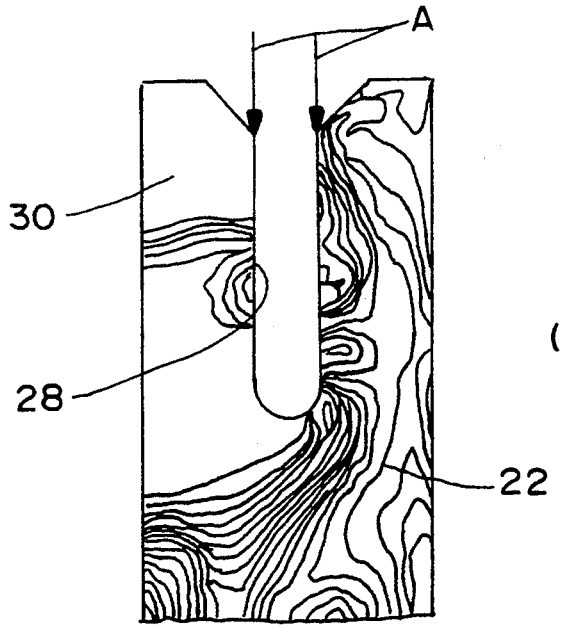
FIG. 2 (PRIOR ART)
FIG. 2 is a fragmented elevational view of one of the slotted side walls of the terminating section of the prior art terminal shown in FIG. 1, along with a diagrammatic illustration of the stress distribution in the slotted side wall.
Figure 3:
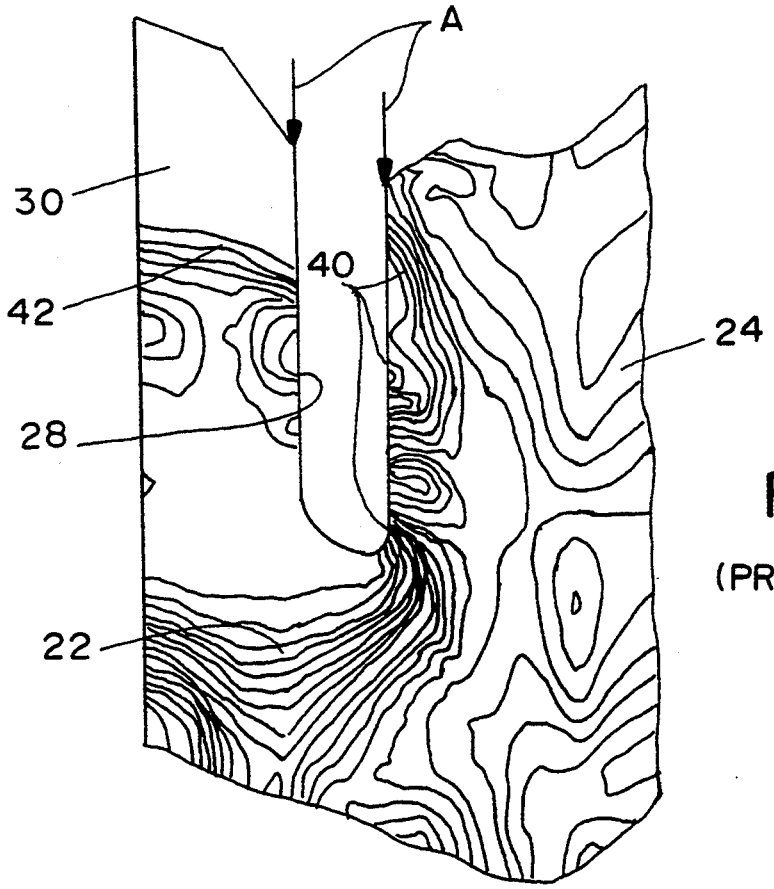
FIG. 3 (PRIOR ART)
FIG. 3 is a perspective view of the side wall and the stress distribution diagram of FIG. 2.

In particular, reference is made to FIGS. 2 and 3 wherein one of the side walls 22 and its respective slot 28 is illustrated, along with the respective free arm portion 30 of the side wall. In addition, FIG. 3 shows a portion of base wall 24. These figures diagrammatically illustrate a stress distribution plot in the side wall, generated by a computer using finite element analysis of an actual terminal fabricated as shown in FIG. 1. Areas 40 on the right-hand side of slot 28 as viewed in FIGS. 2 and 3 illustrate high stress concentration areas as a conductor is forced into the slot. However, as seen in FIG. 3, base wall 24 supports the side wall in these areas and prevent the side wall to the right of the slot from buckling or collapsing. On the contrary, free arm portion 30 on the left-hand side of slot 28 shows little or no stress concentrations because the free arm portion yields or gives under the insertion forces. In fact, line 42 illustrates a total failure of the free arm portion at that point when a conductor has been inserted into the slot. This stress distribution plot was generated in response to a conductor having a diameter of 0.049 inch being inserted into a slot having a width of 0.025 inch. The metal of the terminal, including side wall 22 was on the order of 0.008 inch thick, the metal being fabricated of phosphorous bronze material.

Figure 4:
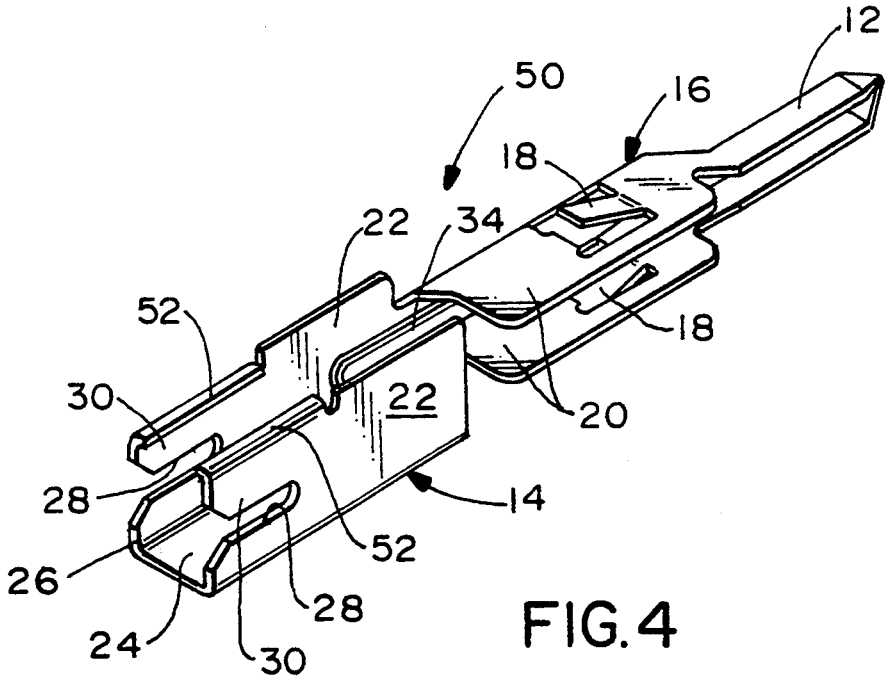
FIG. 4 is a perspective view of an insulation displacement terminal embodying the concepts of the invention.

FIG. 4 shows an insulation displacement terminal, generally designated 50, embodying the concepts of the invention. The terminal is fabricated substantially the same as terminal 10 in FIG. 1, except for the reinforcing means of the invention, and the same reference numerals have been applied in FIG. 4 to represent the same components described above and shown in FIG. 1.

Generally, the invention contemplates the provision of reinforcing means along free edges 32 (FIG. 1) of side walls 22 of terminating section 14 to prevent the side walls, particularly free arm portions 30, from buckling or collapsing when a conductor is forcibly inserted into slots 28. More particularly, flanges 52 are formed longitudinally along free arm portions 30 of side walls 22. The flanges extend longitudinally of the terminal and the terminating section generally parallel to base wall 24 and slots 28. It can be seen that the flanges project inwardly toward each other, i.e. inwardly of the U-shaped configuration of the channel-shaped terminating section. Therefore, the overall peripheral bounds of the terminating section are not enlarged by the additional flanges.

Figure 5:
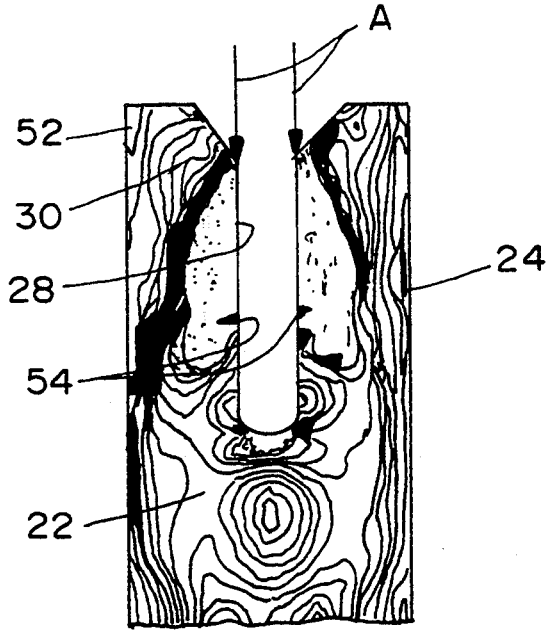
FIG. 5 is a view similar to that of FIG. 2, but of the terminal shown in FIG. 4.
Figure 6:
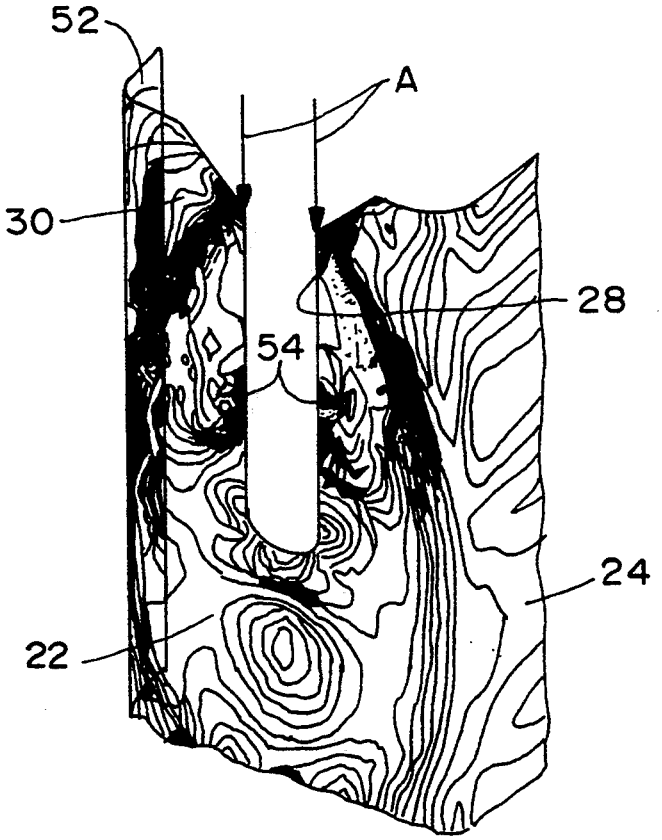
FIG. 6 is a view similar to that of FIG. 3, but of the terminal shown in FIG. 4.

Reference now is made to FIGS. 5 and 6, and particularly to a comparison of FIGS. 5 and 6 with FIGS. 2 and 3, described above. With flange 52 running along one side of side wall 22, i.e. along the free edge of free arm portion 30, and with base wall 24 running along the opposite edge of the side wall, it can be seen that the stress concentration profile 54 on opposite sides of slot 28 are substantially identical. In comparing the stress distribution plot of free arm portion 30 in FIGS. 2 and 3, it can be seen that there are not even any weak points whatsoever in the free arm portion in FIGS. 5 and 6. The results are somewhat surprising in view of the addition of only the relatively small flange-type reinforcing means.

Figure 7:
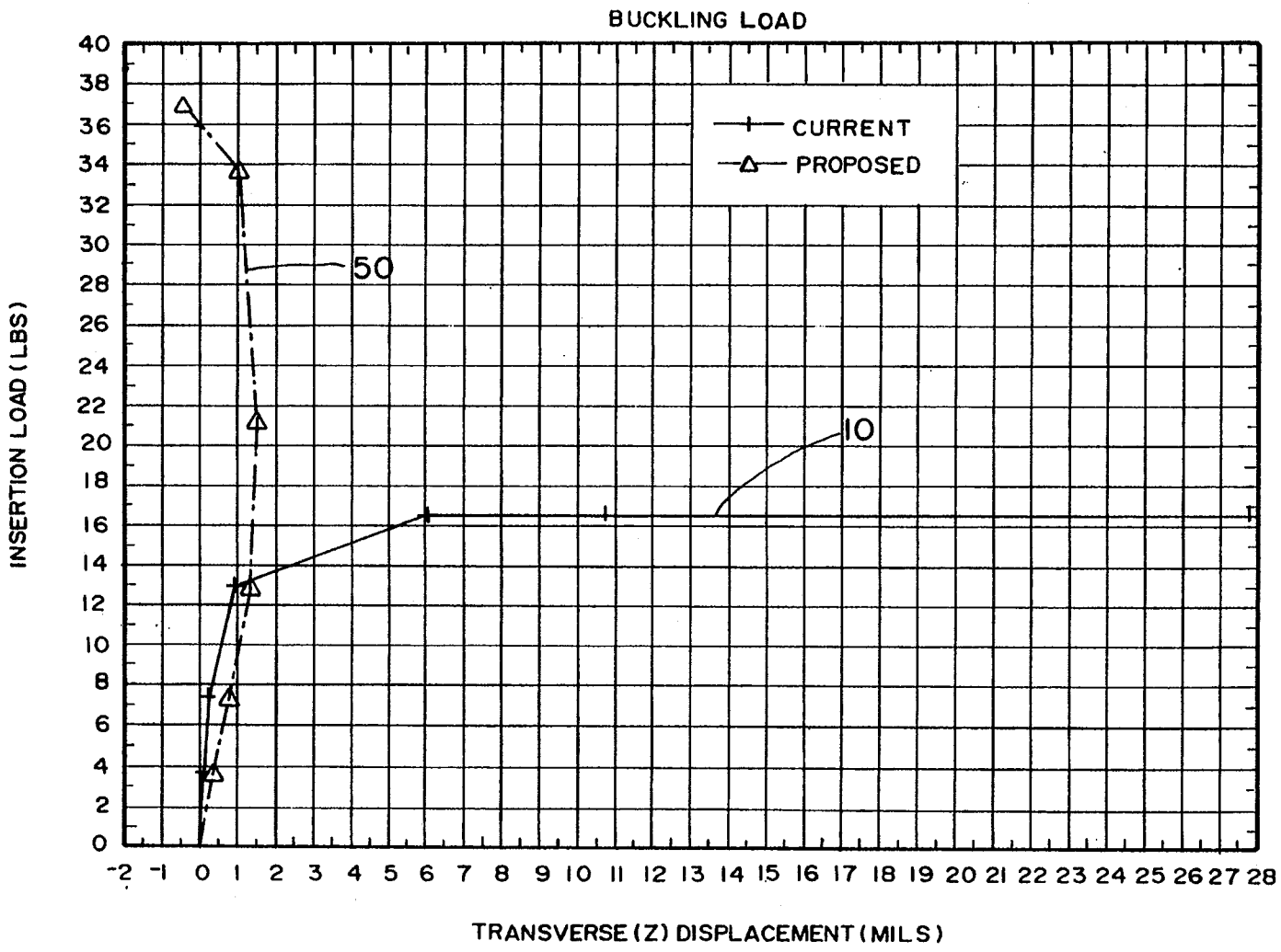
FIG. 7 is a chart illustrating the "buckling load" of the prior art terminal of FIG. 1 versus the terminal of FIG. 4 according to the invention.

Lastly, FIG. 7 shows a graph of the collapsing or buckling load of terminal 10 (FIGS. 1–3) and terminal 50 (FIGS. 4–6). The insertion load in pounds is on the vertical scale of the graph, and the transverse displacement in mils is on the horizontal scale of the graph. Basically, the plotted lines on this graph represent the respective free arm portions 30 of the terminals. In other words, line 10 on the graph represents the unsupported free arm portion of terminal 10, and line 50 on the graph represents the supported free arm portion of terminal 50. It can be seen that line 10 only passes an insertion load of sixteen pounds and remains constant thereafter, to represent that the free arm portion of terminal 10 collapsed or buckled at that load. This is represented by the failure line 42 in FIGS. 2 and 3. On the other hand, terminal 50 and its reinforced free arm portion continues to experience little or no transverse displacement beyond 1.5 mils, all the way to 34–36 pounds. The surprising substantial results of the minimal reinforcing means is quite clearly represented by this graph.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an insulation displacement terminal for an insulated electrical wire, including a channel-shaped terminating section of a generally U-shaped cross-section provided by a pair of side walls joined by a base wall, a U-shaped distal end of the terminating section including a conductor-receiving insulation-displacing slot extending into each side wall of the section generally parallel to the base wall thereof, wherein the improvement comprises reinforcing means along free edges of said side walls of the terminating section of the terminal, said reinforcing means extend generally parallel to the slots, and wherein said reinforcing means comprises elongated flanges projecting from the side walls generally parallel to the base wall.

2. In an insulation displacement terminal as set forth in claim 1, wherein said flanges project inwardly toward each other.

3. An insulation displacement terminal for terminating a conductor of an insulated electrical wire, comprising:

a mating section at one end of the terminal for engaging a complementary electrical contact means;

a terminating section at an opposite end of the terminal for insulation displacement termination with the conductor of the insulated electrical wire;

an intermediate section between the mating section and the terminating section for mounting the terminal in an appropriate connector housing; and said terminating section being channel-shaped with a generally U-shaped cross-section provided by a pair of side walls joined by a base wall, the side walls being generally planar and a U-shaped distal end of the terminating section including a conductor-receiving insulation-displacing slot extending into each planar side wall generally parallel to the base wall, and reinforcing means along free edges of the side walls to prevent free arm portions of the side walls outside the slots from collapsing under forces from a conductor inserted into the slots, said reinforcing means extend generally parallel to the slots, wherein said reinforcing means comprises elongated flanges projecting from the side walls generally parallel to the base wall, and wherein said flanges project inwardly toward each other.

* * * * *